United States Patent [19]

Ono

[11] Patent Number: 4,991,356

[45] Date of Patent: Feb. 12, 1991

[54] ULTRA-PRECISION GRINDING MACHINE

[75] Inventor: Yoshihiko Ono, Kanagawa, Japan

[73] Assignee: Tokiwa Seiki Industrial Company, Ltd., Japan

[21] Appl. No.: 360,342

[22] Filed: Jun. 2, 1989

[30] Foreign Application Priority Data

Jun. 8, 1988 [JP] Japan ..... 63-139233

[51] Int. Cl.[5] ..... B24B 49/00; B24B 51/00

[52] U.S. Cl. ..... 51/165.93; 51/105 R; 51/236

[58] Field of Search ..... 51/240 R, 240 T, 50 PC, 51/51, 60, 34 R, 48 R, 50 R, 48 HE, 240 A, 103 R, 105 R, 105 EC, 165.93, 236, 237 R, 291; 269/283, 281; 82/122; 474/133, 134, 113, 114, 115, 116; 108/139, 140

[56] References Cited

U.S. PATENT DOCUMENTS

| | | | |
|---|---|---|---|
| 3,872,801 | 3/1975 | Weddendorf | 474/114 |
| 4,084,349 | 4/1978 | Farrell | 51/5 D |
| 4,404,741 | 9/1983 | Lebet et al. | 269/73 |
| 4,563,837 | 1/1986 | Ono | 51/34 R |
| 4,564,995 | 1/1986 | Kase | 82/122 |

FOREIGN PATENT DOCUMENTS

| | | |
|---|---|---|
| 0074664 | 3/1983 | Fed. Rep. of Germany . |
| 1092612 | 11/1967 | United Kingdom . |
| 2137127 | 10/1984 | United Kingdom . |

*Primary Examiner*—Frederick R. Schmidt
*Assistant Examiner*—John R. Schwarzmann
*Attorney, Agent, or Firm*—Thomas & Kerr

[57] ABSTRACT

An ultra-precision grinding machine capable of effectively dealing with finishing of a complicated curved groove loop on a workpiece, while improving efficiency and consistency of the operation. The machine includes a processing member carrying a grinding tool; a work table which is slidable and rotatable in a horizontal plane, and which holds a workpiece underneath the grinding tool; and a slide table having a motor for driving the work table in rotational motion, the slide table being slidable in a horizontal plane together with the work table.

3 Claims, 2 Drawing Sheets

ULTRA-PRECISION GRINDING MACHINE

BACKGROUND OF THE INVENTION

1. Field of the Invention

The present invention relates to a machine for grinding workpieces in ultra-precision and, more particularly, to such a ultra-precision grinding machine for finishing circumferences and sides of grooves of the workpieces in ultra-precision.

2. Description of the Background Art

Conventionally, finally of metal pieces manufactured by an electric discharge machine in ultra-high precision has been achieved by using manual operation using an ultrasonic grinding machine. Such a manual operation naturally is associated with problems concerning inefficiency and inconsistency.

As a solution, the present inventor has proposed an improved ultra-precision grinding machine, as disclosed in U.S. Pat. Ser. No. 4,563,837.

According to this improved ultra-precision grinding machine, finishing of a straight groove on a workpieces can be accomplished by operation of transporting the workpiece along the straight groove alone, so that the improvement in efficiency and consistency can be achieved.

However, this improved ultra-precision grinding machine is rather awkward in finishing a complicated curved groove loop on the workpiece.

SUMMARY OF THE INVENTION

It is therefore an object of the present invention to provide an ultra-precision grinding machine capable of effectively dealing with finishing of a complicated curved groove loop on a workpiece, while improving efficiency and consistency of the operation.

This object is achieved in the present invention by providing an ultra-precision grinding machine, comprising a processing member carrying a grinding tool; a work table which is slidable and rotatable in a horizontal plane, and which holds a workpiece underneath the grinding tool; and a slide table having a motor for driving the work table in rotational motion, the slide table being slidable in a horizontal plane together with the work table.

Other features and advantages of the present invention will become apparent from the following description taken in conjunction with the accompanying drawings.

DETAILED DESCRIPTION OF THE PREFERRED EMBODIMENTS

Figure 1:
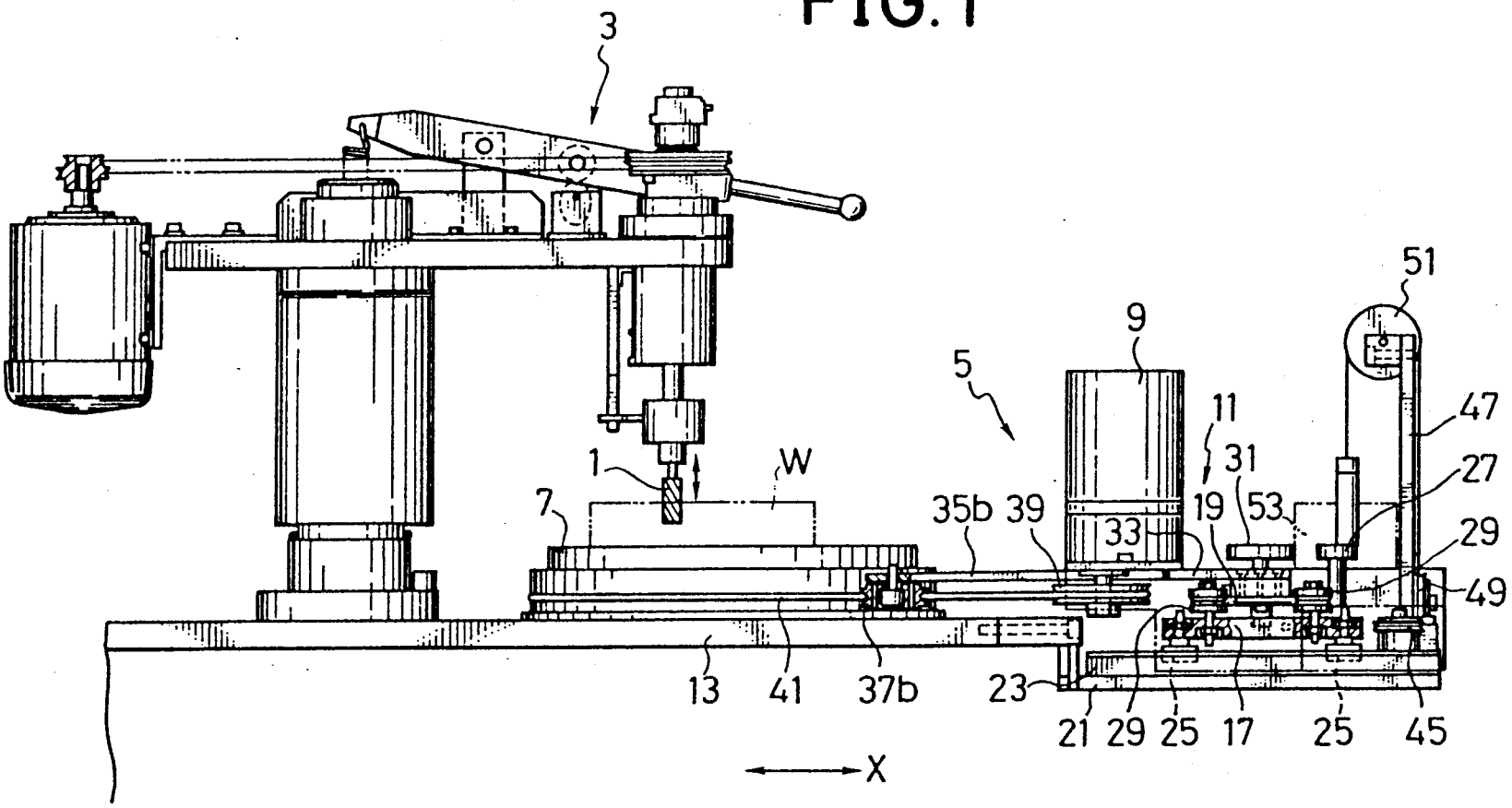
FIG. 1 is a cross sectional view of one embodiment of an ultra-precision grinding machine according to the present invention.
Figure 2:
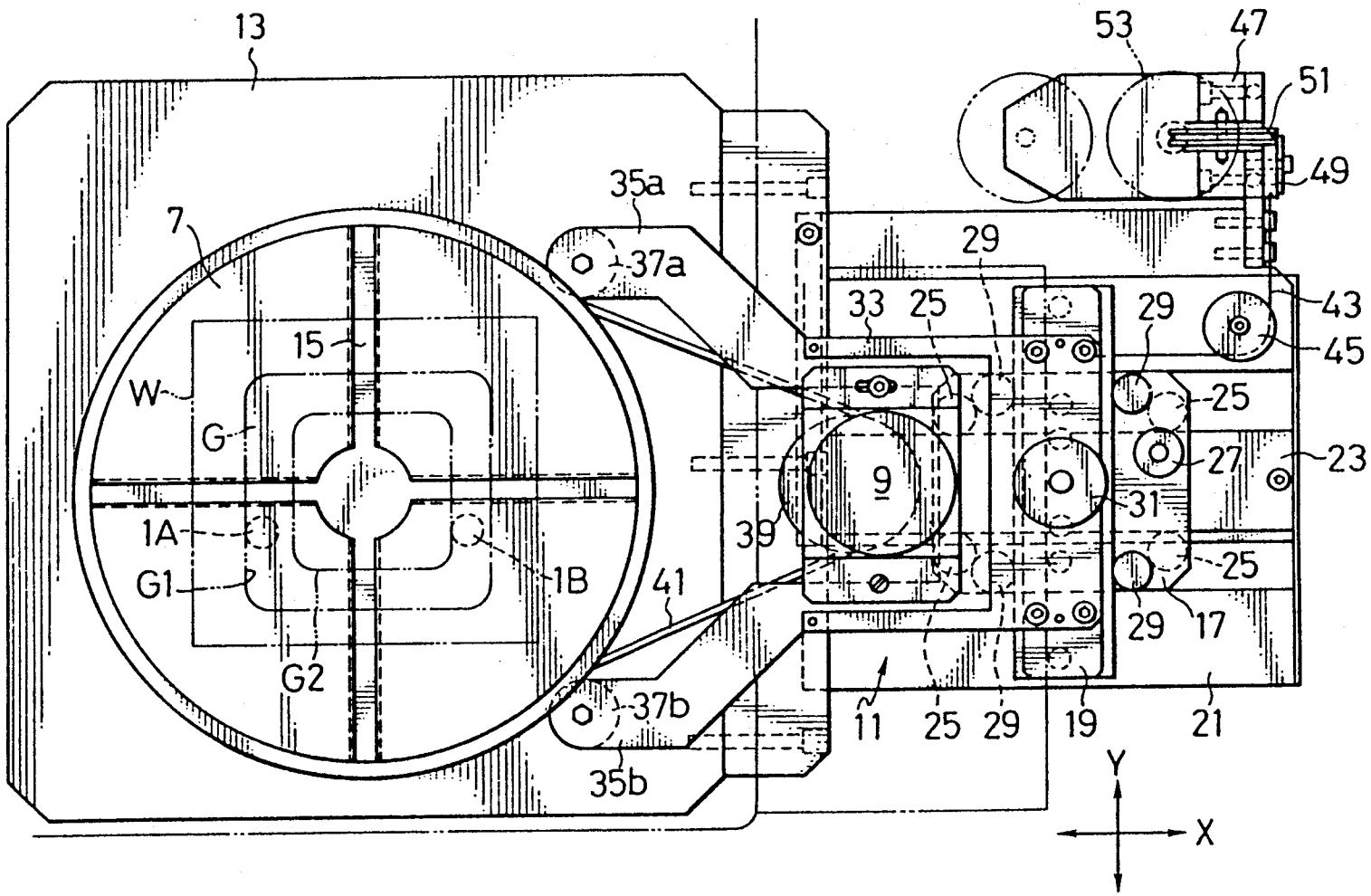
FIG. 2 is a top plan view of one embodiment of an ultra-precision grinding machine according to the present invention.

Referring now to FIGS. 1 and 2, there is shown one embodiment of an ultra-precision grinding machine according to the present invention.

This ultra-precision grinding machine comprises a processing member 3 carrying a grinding tool 1, and a workpiece holding member 5 for holding a workpiece at a desired position.

A detail of the processing member 3 is the same as an apparatus disclosed in aforementioned U.S. Pat. Ser. No. 4,563,837. As described in detail in this reference, in this processing member 3, the grinding tool is supported such that it can move vertically and micro-vibrate horizontally with the amplitude of the micron-vibration being adjustable. Further detail concerning this processing member 3 will not be duplicated here, as it can be found in the reference cited above.

The workpiece holding member 5 further comprises a work table 7 for holding a workpiece W, and a slide table 11 supporting a motor 9 for rotating the work table 7.

The work table 7 is simply placed on top of a base 13 of the processing member 3, and is supported to be slidable and rotatable in a horizontal plane. This work table 7 has a round disk shape, as can be seen from FIG. 2, and its top surface is provided with T-shaped groove 15 across two mutually perpendicular diameters of the disk-shaped work table 7 to be utilized in attaching clamping means for fixing the workpiece W to this work table 7.

The slide table 11 further comprises a X-slide 17 which is movable in X-direction, and a Y-slide 19 which is movable in Y-direction.

The X-slide 17 is movably supported on a X-axis guide rail 23 extending in X-direction, which is provided on a supporting base 21 of the base 13 of the processing member 3, by means of plurality of rollers 25. On top of this X-slide 17, there is provided a fixing knob 27 which fixes the X-slide 17 to the X-axis guide rail 23 by pressing a threaded end to the X-axis guide rail 23, and a plurality of guide rollers 29 for supporting the Y-slide 19 to be movable in Y-direction.

The Y-slide 19 is mounted on the X-slide by means of a fixing knob 31 which fixes the X-slide 19 to the X-slide 17 either by pressing a threaded end to the X-slide 17, or by engaging pin edges through holes provided on the X-slide 17. The Y-slide 19 is also provided with a motor bracket 33 supporting the motor 9, from which symmetrically provided arms 35*a* and 35*b* carrying pulleys 37*a* and 37*b* at their ends extends toward the work table 7.

The motor 9 has a driving pulley 39 on its driving axis, and around this driving pulley 39 and the circumference of the work table 7, a belt 41 is wound. The belt 41 is secured on the circumference of the work table 7 by means of the pulleys 37*a* and 37*b* carried by the arms 35*a* and 35*b*, respectively. Because of this belt 41, the position of the work table 7 is determined with the work table 7 being kept between the pulleys 37*a* and 37*b*, so that the work table 7 and slide table 11 moves together in X- and Y-directions.

As a result of such configuration, the work table 7 can be rotated by activating the motor 9 and, in addition, by moving the X-slide 17 and the Y-slide 19 of the slide table 11 in X- and Y-directions, respectively, the work table 7 can be moved together with the slide table 11 in X- and Y-directions, by means of the arms 35*a* and 35*b* and the belt 41.

Furthermore, in this embodiment, means for moving the work table 7 by pulling the slide table 11 in one direction, X-direction in this embodiment, is provided by a wire 43 connected at one end to a part of the X-slide 17. This wire 43 is wound around a horizontally rotatable pulley 45, a vertically rotatable pulley 49 attached near the bottom of a column 47, and another vertically rotatable pulley 51 attached near the top of the column 47, and is connected at the other end to a removable weight 53 hanging from the pulley 51.

Thus, the slide table 11 and consequently the work table 7 are constantly being pulled in X-direction due to the weight 53, with pulling force being adjustable by appropriately controlling attaching and removing of the weight 53 to the wire 43.

With this ultra-precision grinding machine, finishing of a groove loop G of the workpiece W mounted on the work table 7 can be carried out as follows.

First, the work table 7 is positioned such that in finishing an outer edge G1 of the groove loop G the grinding tool 1 is at a position 1A in FIG. 2 contacting the outer G1 of the groove loop G, while in finishing an inner edge G2 of the groove loop G the grinding tool 1 is at a position 1B in FIG. 2 contacting the inner edge G2 of the groove loop G.

With the grinding tool 1 at the position 1A, the grinding tool 1 is subjected to the vertical motion and the micro-vibration so as to start finishing the outer edge G1 of the groove loop G, while the work table 7 is rotated by means of the motor 9.

As the work table 7 rotates, the outer edge G1 of the groove loop G will be finished all the way around. Here, since the work table 7 is under the constant pulling force in X-direction, contact pressure between the grinding tool 1 and the outer edge G1 is kept constant, so that a uniform finishing can be achieved.

Moreover, since the work table 7 is movable in a horizontal plane, the work table 7 moves in X- and Y-directions while rotating, such that the grinding tool 1 follows the shape of the outer edge G1. Thus, even when the groove loop G has a complicated curved shape, the finishing can be achieved automatically.

The finishing of the inner edge G2 can be accomplished in a similar manner starting from the grinding tool 1 at the position 1B.

It can easily be understood that when the groove loop G has tapering edges, the work table 7 will be oscillating in X-direction automatically as the grinding tool 1 moves up and down, so that the finishing of such tapering edges can also be accomplished automatically.

Thus, according to this embodiment of an ultra-precision grinding machine, it is possible to deal effectively with finishing of a complicated curved groove loop on a workpiece, while improving efficiency and consistency of the operation by being automatic.

It is to be noted that the weight 53 utilized above for providing a constant pulling force to the work table 7 in one direction may be replaced by a torque motor which applies a constant torque, or similar means. Alternatively, this weight 53 and resulting constant pulling force may be eliminated altogether, and the ultra-precision grinding machine may be used in a manner described in aforementioned U.S. Pat. Ser. No. 4,563,837.

Besides these, many modifications and variations of this embodiment may be made without departing from the novel and advantageous features of the present invention. Accordingly, all such modifications and variations are intended to be included within the scope of the appended claims.

What is claimed is:

1. An ultra-precision grinding machine, comprising:

a processing member carrying a grinding tool;

a work table which is slidable and rotatable in a horizontal plane, and which holds a work piece underneath said grinding tool; and a slide table having a motor for driving said work table in rotational motion, said slide table being slidable in a horizontal plane together with said work table, said work table and said motor being connected by a belt wound around a driving pulley connected to a driving axis of said motor and a circumference of said work table, and said slide table including arms extending toward said work table having pulleys which make contact with said circumference of said work table in order to secure said belt on said circumference.

2. The ultra-precision grinding machine of claim 1, further comprising means for providing a constant pulling force to said slide table in one direction on the horizontal plane.

3. An ultra-precision grinding machine for finishing side surfaces of a work piece, comprising:

a support base;

a processing member mounted to said support base;

a slide table slidably mounted to said support base below said processing member for sliding movement in a first horizontal direction and for sliding movement in a second horizontal direction perpendicular to said first horizontal direction;

a grinding tool mounted to said processing member for reciprocating vertical movement and for micro-vibratory horizontal movement;

a work table rotatably and slidably mounted to said support base for supporting a work piece adjacent said grinding tool;

means for rotating said work table comprising a motor mounted to said slide table and coupled to said work table by means of a flexible belt;

means for urging the side surface of the work piece into engagement with said grinding tool with a constant force throughout the finishing operation comprising means for biasing said slide table in said first horizontal direction with a constant force, and wherein the constant force applied to said slide table is communicated to said work table through said flexible belt, whereby the slide table and the work table can slide together horizontally; and wherein said flexible belt is wound around a circumference of said work table and wherein said slide table further comprises arms extending toward said work table, said arms each having a pulley adjacent said circumference of said work table for maintaining said flexible belt on said circumference of said work table;

whereby the micro-vibrator motion of the grinding tool and the rotation of the worktable cause the work piece to tend to move relative to the grinding tool, whereupon the work table, which is slidably mounted to the support base, allows the work piece to move relative to the grinding tool to progressively move the surface of the work piece past the grinding tool, so that in effect the grinding tool automatically follows the existing contours of the work piece.

* * * * *